US010286649B2

(12) United States Patent
Furuyama et al.

(10) Patent No.: US 10,286,649 B2
(45) Date of Patent: May 14, 2019

(54) INKJET RECORDING APPARATUS AND CLEANING METHOD

(71) Applicant: CANON KABUSHIKI KAISHA, Tokyo (JP)

(72) Inventors: Satoko Furuyama, Kawasaki (JP); Kei Kosaka, Tokyo (JP); Tomoyuki Tenkawa, Yokohama (JP); Monta Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/659,112

(22) Filed: Jul. 25, 2017

(65) Prior Publication Data

US 2018/0029356 A1 Feb. 1, 2018

(30) Foreign Application Priority Data

Jul. 29, 2016 (JP) ..... 2016-150411

(51) Int. Cl.
*B41J 2/045* (2006.01)
*B41J 2/165* (2006.01)
*B41J 2/21* (2006.01)

(52) U.S. Cl.
CPC ..... *B41J 2/04508* (2013.01); *B41J 2/04586* (2013.01); *B41J 2/16505* (2013.01); *B41J 2/16508* (2013.01); *B41J 2/16532* (2013.01); *B41J 2/2125* (2013.01); *B41J 2002/16594* (2013.01)

(58) Field of Classification Search
CPC .. B41J 2/2125; B41J 2/04551; B41J 2/04593; B41J 2/16523
See application file for complete search history.

(56) References Cited

U.S. PATENT DOCUMENTS 5,504,508 A * 4/1996 Hashimoto ..... B41J 2/16508 347/24
6,685,310 B2 * 2/2004 Kaga ..... B41J 2/17506 347/30

(Continued)

FOREIGN PATENT DOCUMENTS

CN 1172015 A 2/1998
CN 1669799 A 9/2005

(Continued)

*Primary Examiner* — John Zimmermann
(74) *Attorney, Agent, or Firm* — Canon U.S.A., Inc. IP Division

(57) ABSTRACT

An inkjet recording apparatus includes a recording head including a first discharge port configured to discharge a first amount of ink droplets and a second discharge port configured to discharge a second amount of ink droplets smaller than the first amount, a cap, a suction unit, and a determination unit configured to determine whether to perform a first recording operation by using the first and second discharge ports or a second recording operation by only using the first discharge port. If the first recording operation is determined to be performed, the suction unit performs a first suction operation with a first strength and a second suction operation with a second strength higher than the first strength. If the second recording operation is determined to be performed, the suction unit is controlled not to perform the second suction operation and to perform the first suction operation.

15 Claims, 17 Drawing Sheets

(56) References Cited

U.S. PATENT DOCUMENTS

| | | | | |
|---|---|---|---|---|
| 2002/0030721 | A1* | 3/2002 | Asakawa | B41J 2/14048 347/65 |
| 2003/0043244 | A1 | 3/2003 | Kaga et al. | |
| 2005/0122355 | A1 | 6/2005 | Kanda | |
| 2005/0253909 | A1* | 11/2005 | Usui | B41J 2/175 347/92 |
| 2008/0055357 | A1 | 3/2008 | Hamasaki et al. | |

FOREIGN PATENT DOCUMENTS

| | | | |
|---|---|---|---|
| JP | 2005306013 | A | 11/2005 |
| JP | 2007-296755 | A | 11/2007 |

* cited by examiner

FIG.13

| RECORDING MEDIUM | 5pl | 1pl |
|---|---|---|
| PLAIN PAPER | ● | |
| GLOSSY PAPER | ● | ● |

FIG.14A

| RECORDING MEDIUM/ IMAGE QUALITY | DOT LAYOUT |
|---|---|
| PLAIN PAPER/STANDARD | A |
| PLAIN PAPER/FINE | B |
| GLOSSY PAPER/ STANDARD | C |
| GLOSSY PAPER/FINE | D |
| GLOSSY PAPER/ HIGHEST QUALITY | E |

FIG.14B

| DOT LAYOUT | 5pl | 1pl |
|---|---|---|
| A | ● | |
| B | ● | |
| C | ● | ● |
| D | ● | ● |
| E | ● | ● |

INKJET RECORDING APPARATUS AND CLEANING METHOD

BACKGROUND OF THE INVENTION

Field of the Invention

The present invention relates to an inkjet recording apparatus which records an image by discharging ink from a recording head, and a cleaning method thereof.

Description of the Related Art

An inkjet recording apparatus discussed in Japanese Patent Application Laid-Open No. 2007-296755 includes a recording head that has a nozzle surface in which large discharge port arrays and small discharge port arrays are formed. A plurality of large nozzles having a large diameter is arranged in the large discharge port arrays. A plurality of small nozzles having a small diameter is arranged in the small discharger arrays. The different types of nozzles are used according to a recording mode. The small nozzles have a small discharge port area, and the menisci acting on the interfaces of the discharge ports are higher than those of the large nozzles. The large discharge port arrays and the small discharge port arrays may be capped with a single cap to suck in bubbles mixed in ink. Such a configuration may fail to sufficiently suck in bubbles from the small nozzles. Japanese Patent Application Laid-Open No. 2007-296755 discusses applying a negative pressure to suck in the ink and bubbles from the large nozzles and then perform suction again with a higher negative pressure so that bubbles can be sufficiently sucked in even from the small nozzles.

With the configuration discussed in Japanese Patent Application Laid-Open No. 2007-296755, the suction with the high negative pressure is performed before a start of a recording operation even in a recording mode that does not use the small nozzles. It may therefore take a long time to start the recording operation, in which case the user is kept waiting.

SUMMARY OF THE INVENTION

According to an aspect of the present invention, an inkjet recording apparatus includes a recording head configured to perform a recording operation on a recording medium, the recording head including a discharge port surface in which a first discharge port configured to discharge a first amount of ink droplets and a second discharge port configured to discharge a second amount of ink droplets are formed, the second amount being smaller than the first amount, a cap configured to cap the first and second discharge ports, a suction unit connected to the cap and configured to suck in ink from the recording head with the discharge port surface capped with the cap, and a determination unit configured to determine, based on a recording instruction, which of a plurality of recording operations to be performed by the recording head, the plurality of recording operations including a first recording operation for performing recording on the recording medium by using the first and second discharge ports, and a second recording operation for performing recording on the recording medium by using the first discharge port without using the second discharge port. If the determination unit determines to perform the first recording operation, the suction unit is controlled to perform a first suction operation for sucking in the ink with a first strength and a second suction operation for sucking in the ink with a second strength higher than the first strength before the first recording operation. If the determination unit determines to perform the second recording operation, the suction unit is controlled not to perform the second suction operation and to perform the first suction operation before the second recording operation.

Further features of the present invention will become apparent from the following description of exemplary embodiments with reference to the attached drawings.

BRIEF DESCRIPTION OF THE DRAWINGS

FIG. 13 is a table illustrating a method for determining a recording mode based on a recording medium according to the first exemplary embodiment.

FIGS. 14A and 14B are tables illustrating a method for determining a recording mode based on a dot arrangement according to the first exemplary embodiment.

DESCRIPTION OF THE EMBODIMENTS

Exemplary embodiments of an inkjet recording apparatus according to the present invention will be described. Constituent elements described in the exemplary embodiments are mere illustrative and not intended to limit the scope of the present invention. In the present specification, serial inkjet recording apparatuses will be described as examples. Serial inkjet recording apparatuses perform recording by reciprocating a head for discharging ink at an intermittently-conveyed recording medium in a direction crossing a conveyance direction of the recording medium. The present invention, however, is not limited to serial inkjet recording apparatuses, and may be applied to a line inkjet recording apparatus which continuously performs printing by using a long print head. As employed herein, "ink" refers collectively to liquids such as a recording liquid. "Recording" is not limited to recording on a flat object and may include recording on a three-dimensional object. A "nozzle" refers collectively to a discharge port, a liquid channel communicating with the discharge port, and an element that generates energy used to discharge ink. A "recording medium" refers to an object at which a liquid is discharged. A "recording medium" refers collectively to recording media such as paper, cloth, a plastic film, a metal plate, glass, ceramics, wood, and leather. A recording medium is not limited to a cut sheet of paper and may include a roll of continuous sheet.

Figure 1:
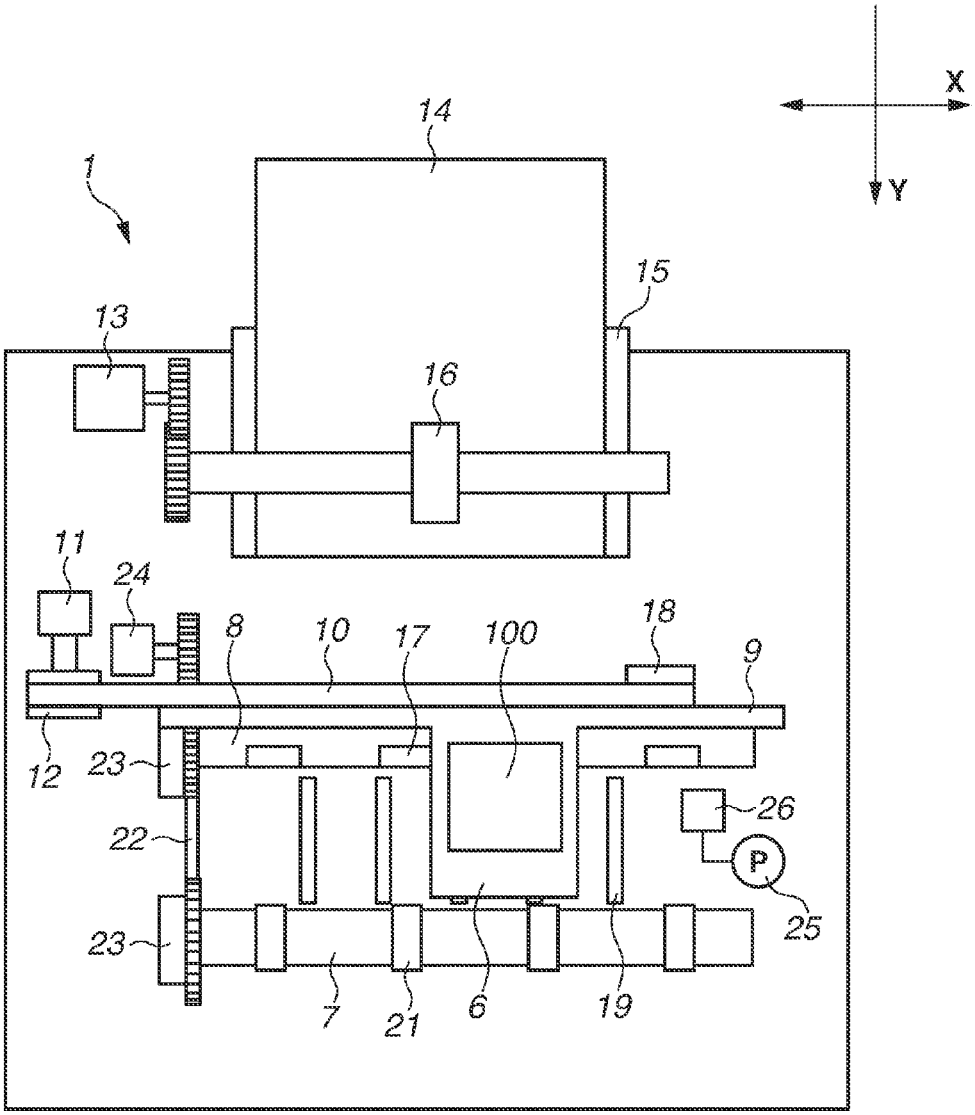
FIG. 1 is a schematic diagram illustrating an inkjet recording apparatus according to a first exemplary embodiment.

A first exemplary embodiment of the present invention will be described below. FIG. 1 is a schematic top view of an inkjet recording apparatus (hereinafter, recording apparatus) 1 according to the present exemplary embodiment. A recording head 102 (see FIG. 2) for discharging ink is detachably mounted on a carriage 6. The recording head 102 includes a discharge port surface 1021 (see FIG. 4) in which a plurality of discharge ports 107 (see FIG. 5) for discharging ink in the form of droplets is formed. A recording head unit 100 includes the recording head 102 and ink tanks 101 for supplying ink to the nozzles of the recording head 102. The recording head 102 includes a connector for transferring a signal (driving signal) for driving the recording head 102. The carriage 6 includes a connector holder for transmitting the driving signal to the recording head 102 via the connector. The carriage 6 is guided and supported by a guide shaft 9. The carriage 6 is configured to be capable of reciprocating in a direction in which the guide shaft 9 extends (X direction in FIG. 1). The carriage 6 is driven by a carriage motor 11 via a driving mechanism including a motor pulley 12, a driven pulley 18, and a timing belt 10.

Recording media 14 are stacked on an auto sheet feeder 15. If a recording instruction is received, a feed motor 13 is driven and its driving force is transmitted to a pickup roller 16 via gears. This rotates the pickup roller 16, and the recording media 14 stacked on the auto sheet feeder 15 are separated and fed into the recording apparatus 1 one by one from the top. The recording medium 14 fed into the recording apparatus 1 is conveyed in a Y direction in FIG. 1 by rotational force of a conveyance roller 8. A conveyance motor 24 is driven to generate rotational force which is transmitted via gears to rotate the conveyance roller 8. The conveyance roller 8 and pinch rollers 17 arranged in opposite positions sandwich and convey the recording medium 14. The conveyance roller 8 is connected to a discharge roller 7 via a belt member 22. The discharge roller 7 is configured to rotate as the conveyance roller 8 rotates. The discharge roller 7 and spur rollers 21 arranged in opposite positions also sandwich and convey the recording medium 14. A not-illustrated rotation angle sensor detects positions of slits in a code wheel 23 attached to the conveyance roller 8. The information about the positions is fed back to a control driver of the conveyance motor 24, whereby the rotation amount and the rotation speed of the conveyance roller 8 are controlled.

A platen 19 is arranged between the conveyance roller 8 and the discharge roller 7, in a position opposed to the discharge port surface 1021 of the recording head 102. The platen 19 supports the conveyed recording medium 14 from vertically below. The recording head 102 discharges ink from the discharge ports (nozzles) 107 while the carriage 6 moves in the X direction, whereby a band of image is formed on the recording medium 14. After the formation of a band of image on the recording medium 14, the recording medium 14 is conveyed in the Y direction by a predetermined conveyance amount by the rotation of the conveyance roller 8 and the discharge roller 7 (intermittent conveyance). The recording operation and the intermittent conveyance operation for one band are repeated to form an image on the entire recording medium 14. The image-formed recording medium 14 is discharged from the recording apparatus 1 by the discharge roller 7.

A suction cap (cap) 26 is arranged in a moving area of the carriage 6, outside an area (recording area) in which recording is performed on the recording medium 14. The discharge port surface 1021 can be capped (covered) with the cap 26 to prevent the discharge ports 107 from drying during non-recording operations. A suction pump (pump) 25 sucks in ink from the discharge ports 107 of the recording head 102 by making the interior of the cap 26 negative in pressure, with the discharge port surface 1021 capped (covered) with the cap 26. The cap 26 is designed in size such that the entire discharge port surface 1021 can be capped. The cap 26 can thus suck in the ink from all the discharge ports 107.

Figure 2:
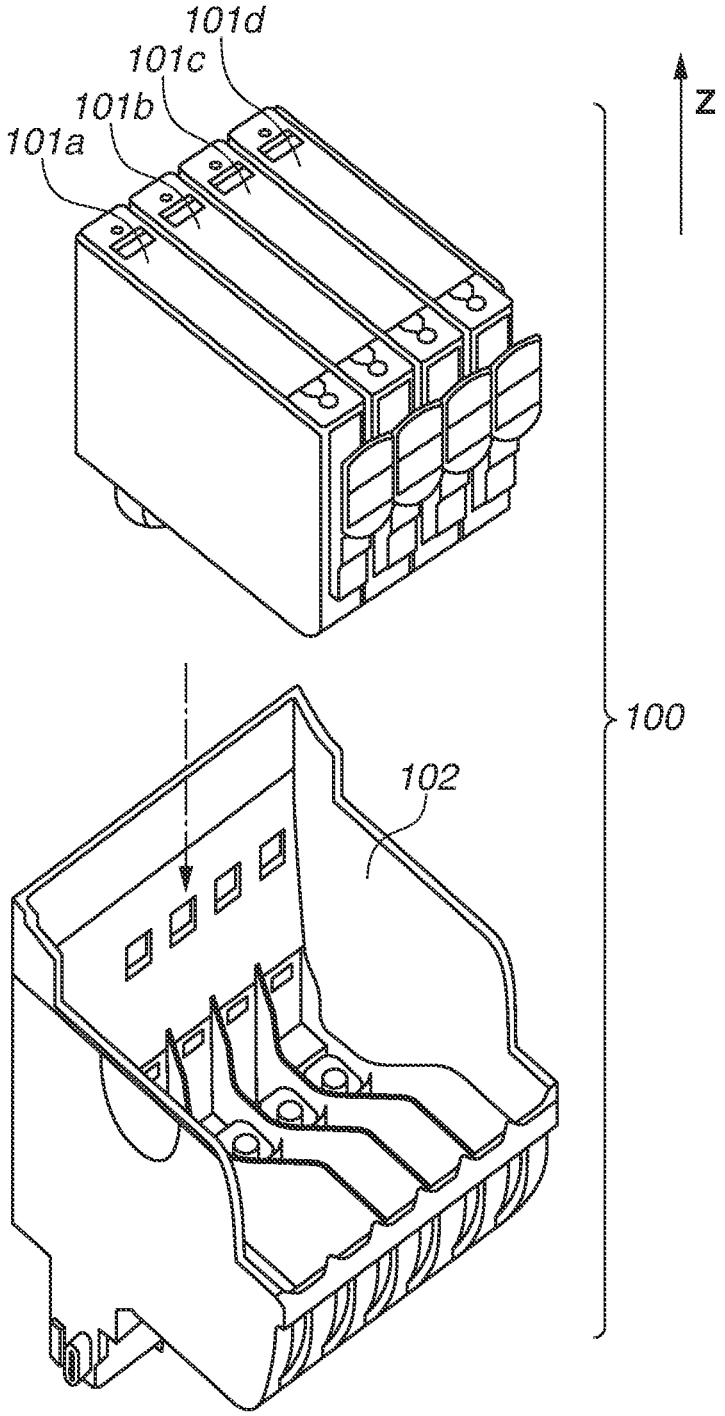
FIG. 2 is a schematic diagram illustrating a recording head unit according to the first exemplary embodiment.

FIG. 2 is a schematic diagram illustrating the recording head unit 100 according to the present exemplary embodiment. The ink tanks 101 containing ink are detachably mounted on the recording head 102. In the present exemplary embodiment, there are mounted four independent ink tanks 101 including a cyan ink tank 101*a*, a magenta ink tank 101*b*, a yellow ink tank 101*c*, and a black ink tank 101*d*. While the present exemplary embodiment uses four color inks, the present invention is not limited thereto. For example, three or less of the color inks may be used. Four or more color inks including a different color ink or inks may be used. Examples of the different color inks include gray ink, pigment black ink, and light cyan ink.

Figure 3:
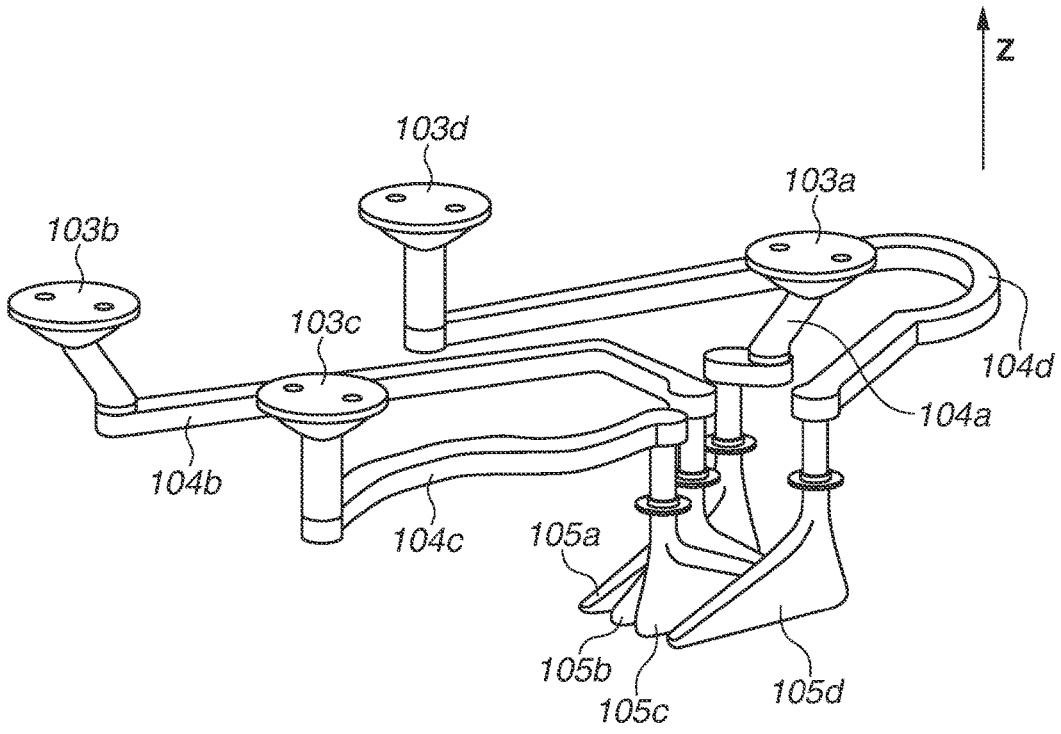
FIG. 3 is a schematic diagram illustrating ink channels of a recording head according to the first exemplary embodiment.

Next, a configuration of the recording head 102 will be described in detail with reference to FIGS. 3, 4, and 5. FIG. 3 is a schematic diagram illustrating ink channels of the recording head 102. The ink channels of the recording head 102 include filter portions 103, ink channel portions 104, and common ink chambers 105. The filter portions 103, the ink channel portions 104, and the common ink chambers 105 are all independently provided for respective four colors cyan, magenta, yellow, and black. The suffix a represents cyan, b magenta, c yellow, and d black. Metal filters are thermally welded to the filter portions 103. The filter portions 103 are coupling portions with the ink tanks 101, and have both the function of generating capillary force for supplying the ink from the ink tanks 101 and the function of preventing intrusion of dust from outside. The ink channel portions 104 are channels for supplying the ink from the filter portions 103 to the nozzles. The ink channel portions 104 communicate with the common ink chambers 105. The common ink chambers 105 are formed to include a space sloping vertically upward (Z direction) so that bubbles mixed in the ink are likely to be collected vertically above.

Figure 4:
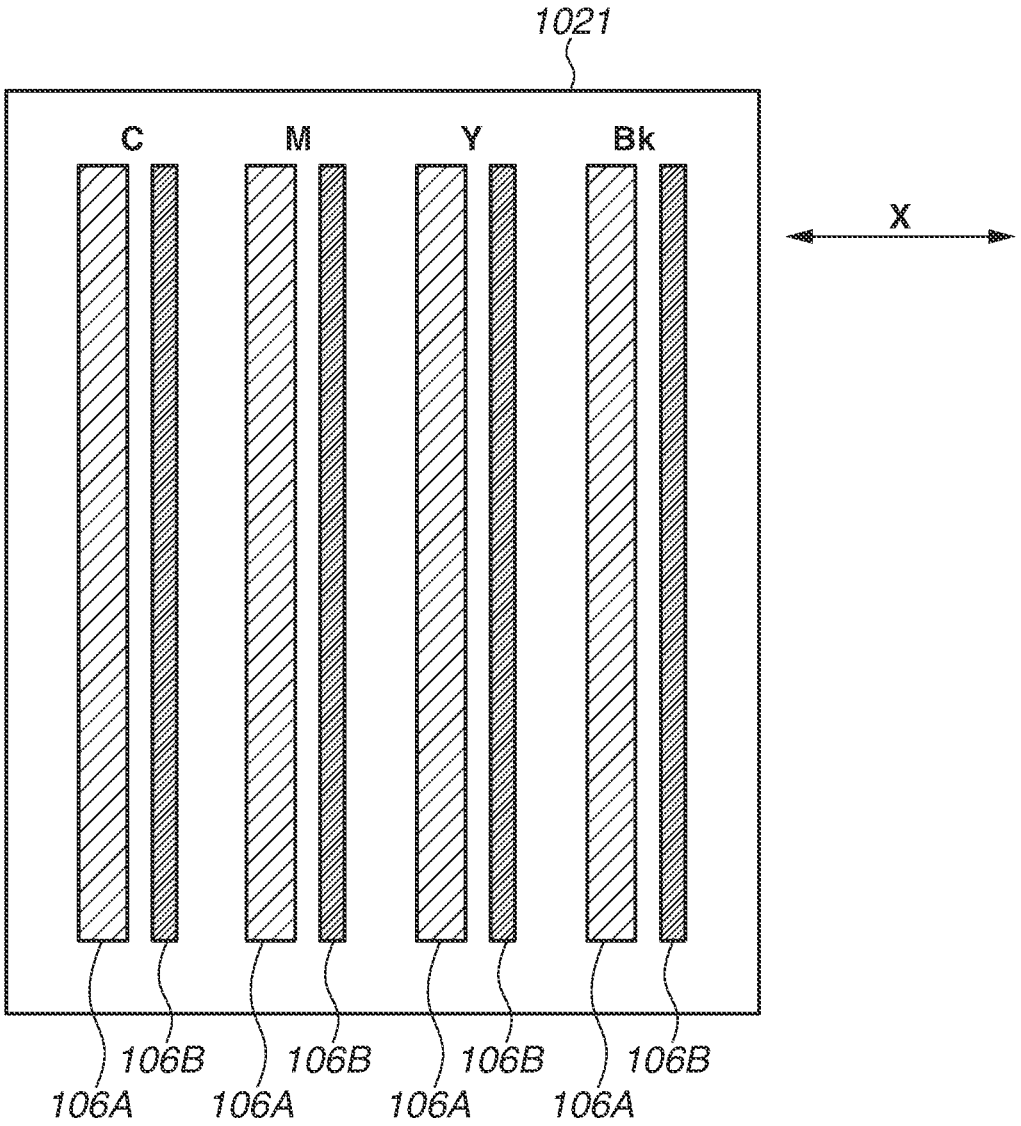
FIG. 4 is a schematic transparent view of discharge port arrays according to the first exemplary embodiment, seen from the ink channel side.

FIG. 4 is a transparent view of the discharge port surface 1021 as seen from the ink channel side (vertically above). The discharge port surface 1021 includes a first discharge port array 106A and a second discharge port array 106B for each color. A plurality of first discharge ports 107A is arranged in the first discharge port array 106A. A plurality of second discharge ports 107B having a diameter (nozzle diameter) smaller than that of the first discharge ports 107A is arranged in the second discharge port array 106B. In the present exemplary embodiment, the first discharge ports 107A can discharge ink droplets of 5 pl. The second discharge ports 107B can discharge ink droplets of 1 pl. The nozzles arranged in the first discharge port arrays 106A and those arranged in the second discharge port arrays 106B will hereinafter be referred to as 5-pl nozzles and 1-pl nozzles, respectively. The 5-pl nozzles have a nozzle diameter of approximately 16.4 μm. The 1-pl nozzles have a nozzle diameter of approximately 9.2 μm. Cyan (C) 5-pl nozzles, cyan (C) 1-pl nozzles, magenta (M) 5-pl nozzles, and magenta (M) 1-pl nozzles are arranged on the discharge port surface 1021 in order from the left. Yellow (Y) 5-pl nozzles, yellow (Y) 1-pl nozzles, black (Bk) 5-pl nozzles, and black (Bk) 1-pl nozzles are further arranged. In the present exemplary embodiment, 512 5-pl nozzles and 512 1-pl nozzles are formed for each color. The discharge port arrays 106 have a discharge port interval of 600 dpi.

Figure 5:
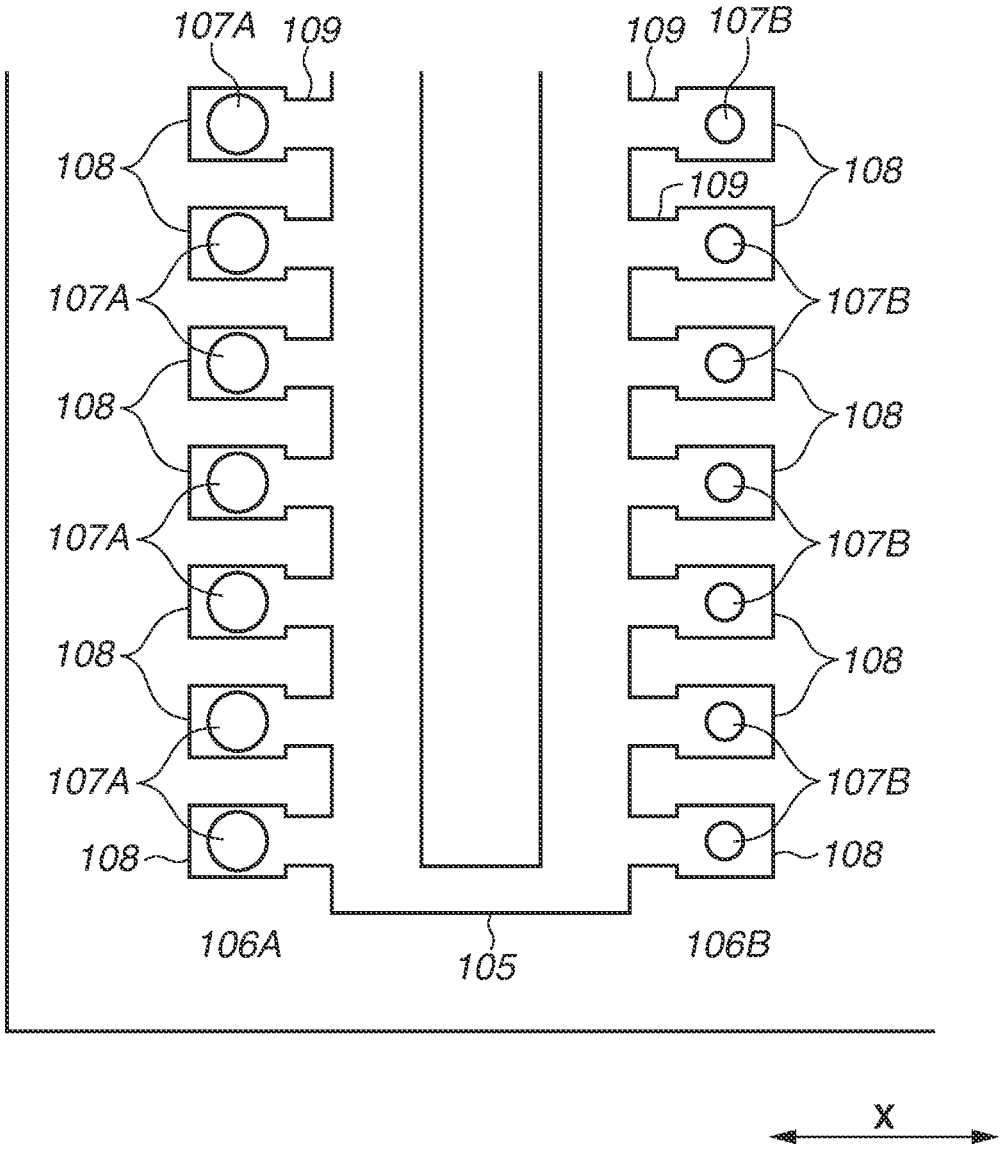
FIG. 5 is a schematic partial enlarged view of the discharge port arrays according to the first exemplary embodiment.

FIG. 5 is a schematic partial enlarged view of the discharge port arrays 106 of FIG. 4. Ink is supplied from the common ink chamber 105 arranged between the first discharge port array 106A and the second discharge port array 106B to the discharge ports (nozzles) 107 via respective ink introduction portions 109. The nozzles 107 include an ink bubble forming chamber 108 each. The recording head 102 is a recording head of an inkjet system in which thermal energy is used to discharge ink. The recording head 102 includes a plurality of electrothermal transducers for generating the thermal energy. More specifically, the recording head 102 generates thermal energy by using pulse signals applied to the electrothermal transducers, causes film boiling of the ink in the ink bubble forming chambers 108 by the thermal energy, and discharges the ink from the discharge ports 107 by using the bubbling pressure of the film boiling.

Figure 6:
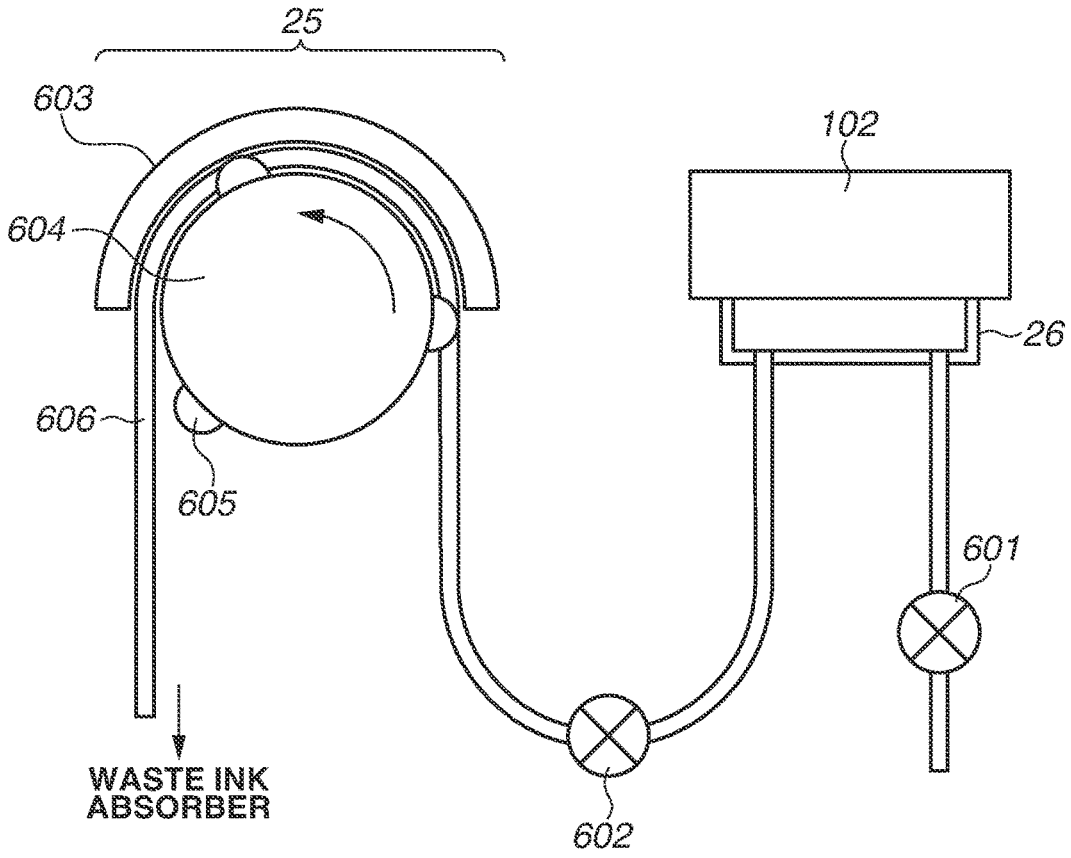
FIG. 6 is a schematic diagram illustrating a suction unit according to the first exemplary embodiment.

Next, a suction unit according to the present exemplary embodiment will be described. FIG. 6 is a schematic diagram illustrating the suction unit according to the present exemplary embodiment. The suction unit includes the cap 26, a suction tube (tube) 606, and a pump 25. The cap 26 covers the discharge port surface 1021 of the recording head 102. One end of the tube 606 is connected to the cap 26, and the other end is connected to a not-illustrated waste ink absorber. The pump 25 is arranged on the tube 606. The pump 25 includes a shaft 604 and a plurality of rollers 605 arranged on the periphery of the shaft 604. If the shaft 604 of the pump 25 rotates in the direction of the arrow (in the diagram, counterclockwise), the tube 606 held by the rollers 605 and a guide 603 is sequentially compressed to depressurize the interior of the tube 606. With the discharge port surface 1021 of the recording head 102 capped with the cap 26, a negative pressure can thus be generated inside the cap 26 to perform normal suction (first suction operation) for sucking in the ink from the discharge port arrays 106 of the recording head 102. The suction amount of the suction operation is determined by the number of rotations and the rotation speed of the rollers 605 which are defined in advance. After the pump 25 is rotated a predetermined number of rotations, the pump 25 stops being driven. The cap 26 is then separated from the discharge port surface 1021 (cap open) to make the interior of the cap 26 communicate with the air. An air open valve 601 arranged on an air open channel connected to the cap 26 may be opened.

The suction unit according to the present exemplary embodiment further includes a charge valve (on-off valve) 602 on the way of the tube 606. The charge valve 602 is arranged between the cap 26 and the pump 25, and can switch between a state in which the channel between the cap 26 and the pump 25 communicates (open state) and a state in which the channel does not communicate (closed state). If the pump 25 is driven to rotate the shaft 604 including the rollers 605 in the direction of the arrow with the charge valve 602 in the closed state, the interior of the tube 606 arranged between the charge valve 602 and the pump 25 is depressurized to generate a high negative pressure. If the pump 25 stops being driven in such a state and the charge valve 602 is switched to the open state, charge suction (second suction operation) can be performed to suck in the ink from the discharge port arrays 106 of the recording head 102 via the cap 26. Since the charge suction is performed by using the charge valve 602 to charge the negative pressure for suction, the ink can be sucked in from the discharge port arrays 106 with a negative pressure higher than in the normal suction which does not use the foregoing charge valve 602. A solenoid valve may be used for the charge valve 602. From the viewpoint of cost and size, however, a valve that mechanically presses the tube 606 is suitably used. During the normal suction, the charge valve 602 is in the open state.

Figure 7:
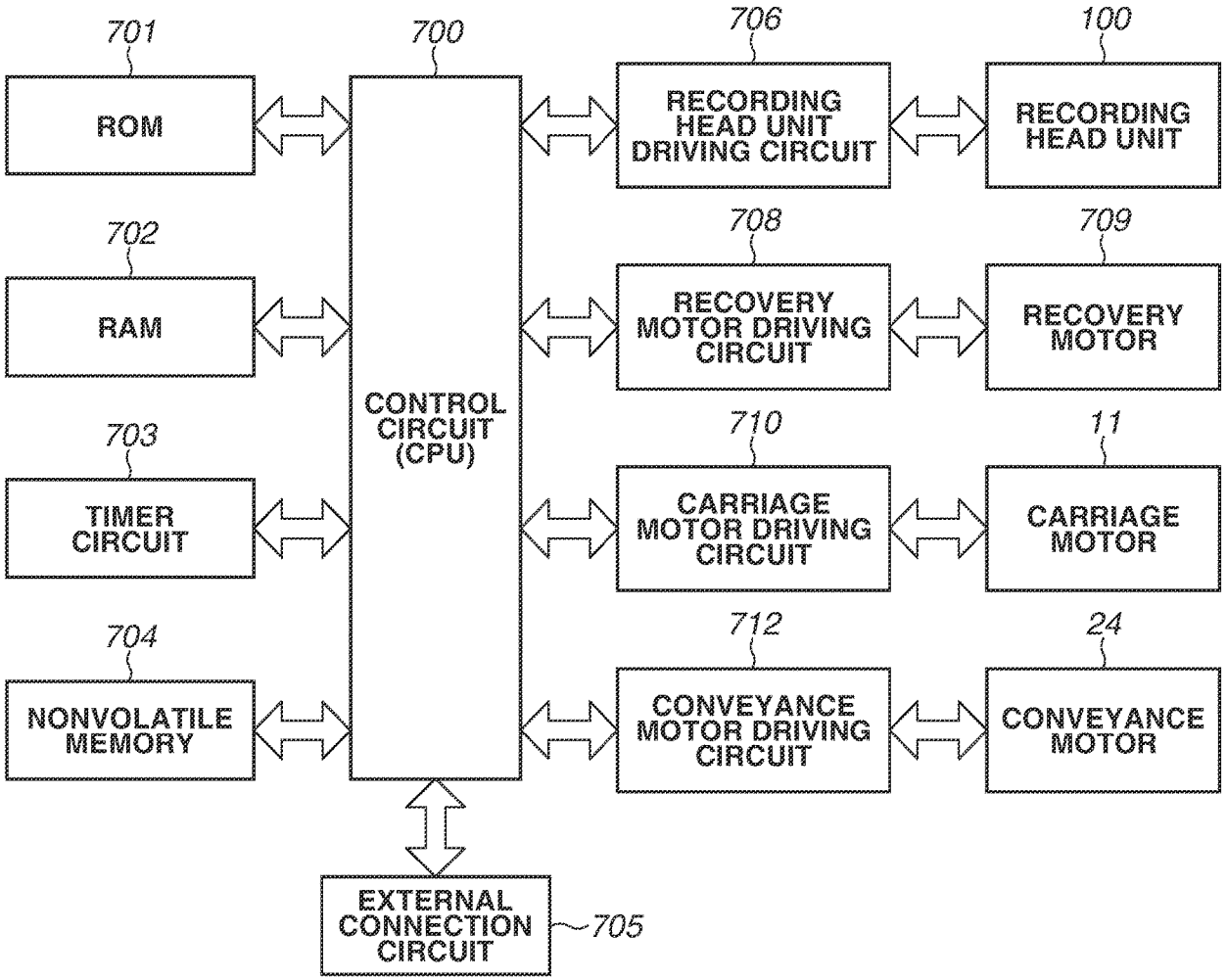
FIG. 7 is a block diagram illustrating a control configuration according to the first exemplary embodiment.

FIG. 7 is a block diagram illustrating a control configuration according to the present exemplary embodiment. A read-only memory (ROM) 701 stores a control program to be executed and various setting values for control. A random access memory (RAM) 702 is used to load data in executing the control program, store print data and control instructions, and store control variables in various controls. A timer circuit 703 is a circuit that can obtain information about the current time or a circuit that can measure elapsed time. A nonvolatile memory 704 can store parameters used for control even in a state where a main body of the recording apparatus 1 is powered off. In the control of the present exemplary embodiment, the nonvolatile memory 704 is used to write and read a time serving as a start point in calculating the elapsed time. A control circuit (determination unit) 700 mainly includes a central processing unit (CPU) which executes the control program stored in the ROM 701 and a control program loaded into the RAM 702. An external connection circuit 705 is a circuit for the control circuit 700 to handle interfaces and control signals in performing wired or wireless communication between the main body of the recording apparatus 1 and an external host apparatus. Image data (recording instruction) to be recorded in the recording apparatus 1 is input from the external host apparatus to the recording apparatus 1 via the external connection circuit 705. The current time may be input to the recording apparatus 1 via the external connection circuit 705.

The control circuit 700 loads the received image data into the RAM 702. Based on the image data loaded in the RAM 702, the control unit 700 controls driving of the recording head unit 100 via a recording head unit driving circuit 706. At the same time, the control unit 700 controls driving of the carriage motor 11 via a carriage motor driving circuit 710. By the control of the control circuit 700 for one recording operation, the recording head 102 discharges ink at desired positions on the recording medium 14 while the carriage 6 is moving, whereby a band of image is formed on the recording medium 14. The control unit 700 also controls the conveyance motor 24 via the conveyance motor driving circuit 712 to intermittently convey the recording medium 14. The control circuit 700 further controls a recovery motor 709 via a recovery motor driving circuit 708 to perform a suction operation (normal suction and/or charge suction) for sucking in a predetermined amount of ink from the recording head 102. The suction operation is performed by the recovery motor 709 rotating the shaft 604 of the pump 25 on which the rollers 605 are arranged. The recovery motor 709 is also controlled to perform a capping operation of the discharge port surface 1021 with the cap 26 and a wiping operation of the discharge port surface 1021 by a not-illustrated wiper. The control unit 700 controls the driving of the recording head unit 100 via the recording head unit driving circuit 706 to perform a preliminary discharge. The preliminary discharge refers to discharging a predetermined amount of ink not contributing to recording at the cap 26. Like the foregoing recording operation, a driving pattern of the recording head 102 in such a case is based on any of the data loaded into the RAM 702, data on the ROM 701, and data generated by the control circuit 700.

Next, a recovery operation performed in the present exemplary embodiment will be described. The recording apparatus 1 performs a recovery operation (cleaning operation) of the recording head 102 through a suction operation. Purposes of the recovery operation include to remove bubbles in the recording head 102, to discharge solidified ink, and to fill ink. Conditions in which the recovery operation is needed include when the ink tank 101 is replaced, when the elapsed time from the previous recovery operation exceeds a predetermined time, and when the discharge amount (number of dots) of ink droplets discharged since the previous recovery operation (after a normal suction operation) reaches or exceeds a predetermined value. In the present exemplary embodiment, the foregoing three cases will be described. In such situations, a recovery request flag (first flag) is turned ON. Information about the recovery request flag is stored in the nonvolatile memory 704 illustrated in FIG. 7. If the recovery request flag is ON, the recording apparatus 1 performs the recovery operation at predetermined timing such as before a recording operation.

Figure 8:
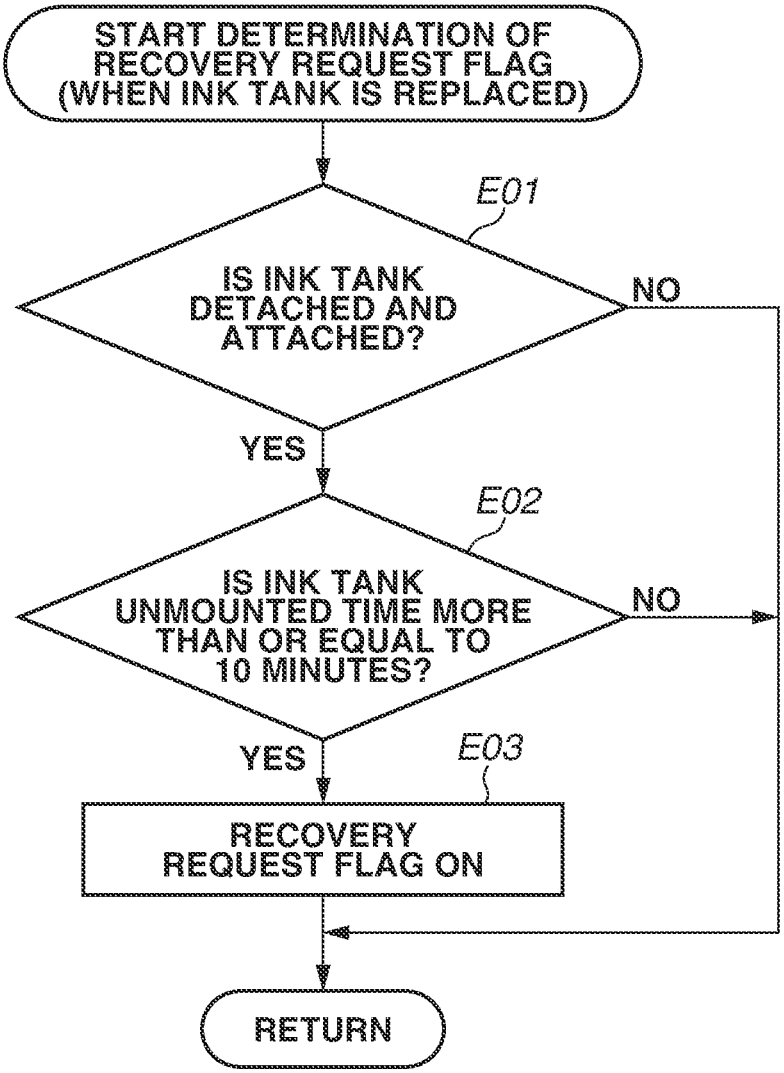
FIG. 8 is a flowchart illustrating control for turning a recovery request flag ON when an ink tank is replaced according to the first exemplary embodiment.

Control for turning ON the recovery request flag when the ink tank 101 is replaced will initially be described with reference to FIG. 8. In step E01, the control circuit 700 (hereinafter, referred to as CPU 700) determines whether the ink tank 101 is detached and attached by a user. In step E01, if no ink tank 101 is detached or attached (NO in step E01), the processing is ended with the recover request flag left OFF. In step E01, if the ink tank 101 is detached and attached (YES in step E01), the processing proceeds to step E02. In step E02, the CPU 700 determines whether time between the detachment and attachment of the ink tank 101 by the user (ink tank unmounted time) is more than or equal to a threshold. FIG. 8 illustrates an example in which the threshold is set to 10 minutes. In step E02, if the ink tank unmounted time is less than 10 minutes (NO in step E02), the processing is ended with the recovery request flag OFF. In step E02, if the ink tank unmounted time is more than or equal to 10 minutes (YES in step E02), the processing proceeds to step E03. In step E03, the CPU 700 turns the recovery request flag ON. The processing is ended.

Figure 9:
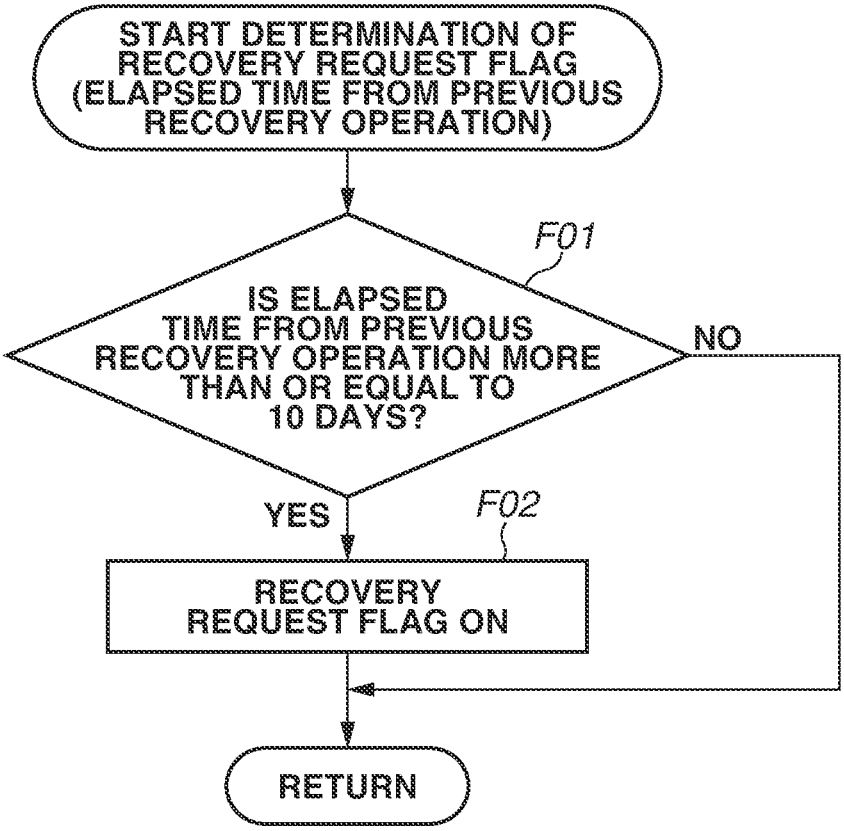
FIG. 9 is a flowchart for describing control for turning the recovery request flag ON according to elapsed time from the previous recovery operation according to the first exemplary embodiment.

Next, control for turning ON the recovery request flag when the elapsed time from the previous recovery operation exceeds a predetermined time will be described with reference to FIG. 9. In step F01, the CPU 700 determines whether the elapsed time from the previous recovery operation is more than or equal to a threshold. FIG. 9 illustrates a case in which the threshold is 10 days. In step F01, if the elapsed time from the previous recovery operation is less than 10 days (NO in step F01), the processing is ended without turning the recovery request flag ON (with the recovery request flag OFF). In step F01, if the elapsed time from the previous recovery operation is more than or equal to 10 days (YES in step F01), the processing proceeds to step F02. In step F02, the CPU 700 turns the recovery request flag ON. The processing is ended.

The count value of the elapsed time is reset at timing after a recovery operation including the normal suction is performed. If a recovery operation including only the charge suction without the normal suction is performed, the count value of the elapsed time is not reset but continued.

Next, control for turning ON the recovery request flag when the number of dots discharged after the previous recovery operation is greater than or equal to a predetermined value will be described with reference to FIG. 10. In step G01, the CPU 700 obtains the count values (numbers of dots) of ink droplets (dots) discharged from the respective discharge port arrays of respective colors since the previous recovery operation is performed. Dcount(5 pl)_c represents the number of dots discharged from the first discharge port array 106A of cyan. Dcount(1 pl)_c represents the number of dots discharged from the second discharge port array 106B of cyan. Similarly, Dcount(5 pl)_m represents the number of dots discharged from the first discharge port array 106A of magenta. Dcount(1 pl)_m represents the number of dots discharged from the second discharge port array 106B of magenta. Dcount(5 pl)_y represents the number of dots discharged from the first discharge port array 106A of yellow. Dcount(1 pl)_y represents the number of dots discharged from the second discharge port array 106B of yellow. The numbers of dots are stored in the nonvolatile memory 704 illustrated in FIG. 7.

In step G02, the CPU 700 determines whether the sum of the numbers of dots discharged from the first and second discharge port arrays 106A and 106B of cyan (Dcount(5 pl)_c+Dcount(1 pl_) c) is greater than or equal to a threshold. FIG. 10 illustrates a case in which the threshold is $5.0\times10^8$. In step G02, if the sum of the numbers of cyan dots is determined to be greater than or equal to the threshold (YES in step G02), the processing proceeds to step G05. In step G05, the CPU 700 turns the recovery request flag ON. The processing is ended. In step G02, if the sum of the numbers of cyan dots is determined to be less than the threshold (NO in step G02), the processing proceeds to step G03. In step G03, the CPU 700 determines whether the sum of the numbers of dots discharged from the first and second discharge port arrays 106A and 106B of magenta (Dcount(5 pl)_m+Dcount(1 pl)_m) is greater than or equal to a threshold. Like cyan, the threshold is $5.0\times10^8$. In step G03, if the sum of the numbers of magenta dots is determined to be greater than or equal to the threshold (YES in step G03), the processing proceeds to step G05. In step G05, the CPU 700 turns the recovery request flag ON. The processing is ended. In step G03, if the sum of the numbers of magenta dots is determined to be less than the threshold (NO in step G03), the processing proceeds to step G04. In step G04, the CPU 700 determines whether the sum of the numbers of dots discharged from the first and second discharge port arrays 106A and 106B of yellow (Dcount(5 pl)_y+Dcount(1 pl)_y) is greater than or equal to a threshold. Like cyan and magenta, the threshold is $5.0\times10^8$. In step G04, if the sum of the numbers of yellow dots is determined to be greater than or equal to the threshold (YES in step G04), the processing proceeds to step G05. In step G05, the CPU 700 turns the recovery request flag ON. The processing is ended. In step G04, if the sum of the numbers of yellow dots is determined to be less than the threshold (NO in step G04), the processing is ended without turning the recovery request flag ON (with the recovery request flag OFF).

Figure 10:
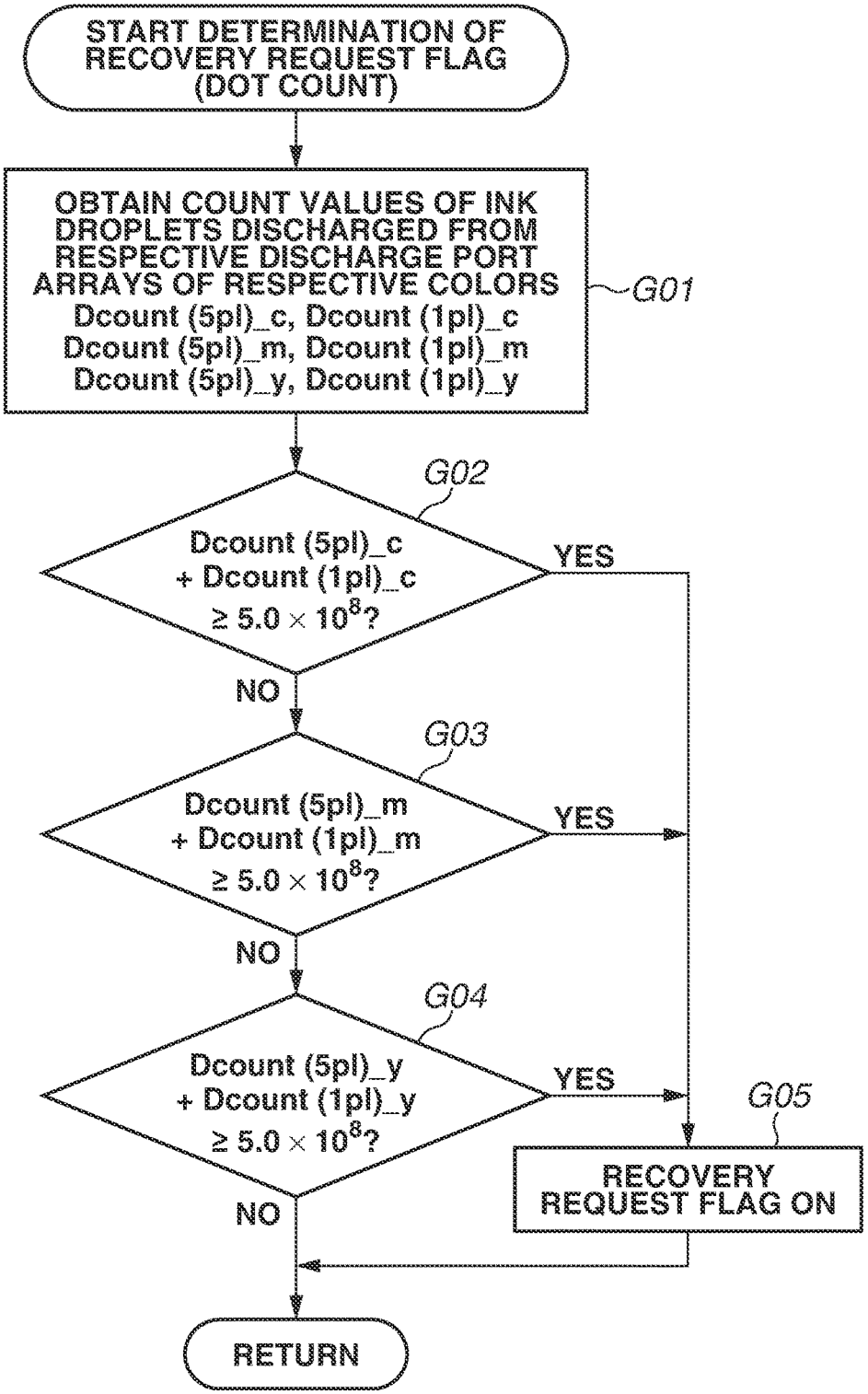
FIG. 10 is a flowchart for describing control for turning the recovery request flag ON based on the number of dots according to the first exemplary embodiment.

The CPU 700 resets the count values of the numbers of dots illustrated in FIG. 10 and resumes counting from 0 after a recovery operation including the normal suction is performed. Since the recovery operation is performed on the nozzles of all the colors, the count values of all the colors are reset. The numbers of dots to be counted include not only the numbers of ink droplets discharged in recording operations, but also those of ink droplets discharged in preliminary discharges.

Figure 11:
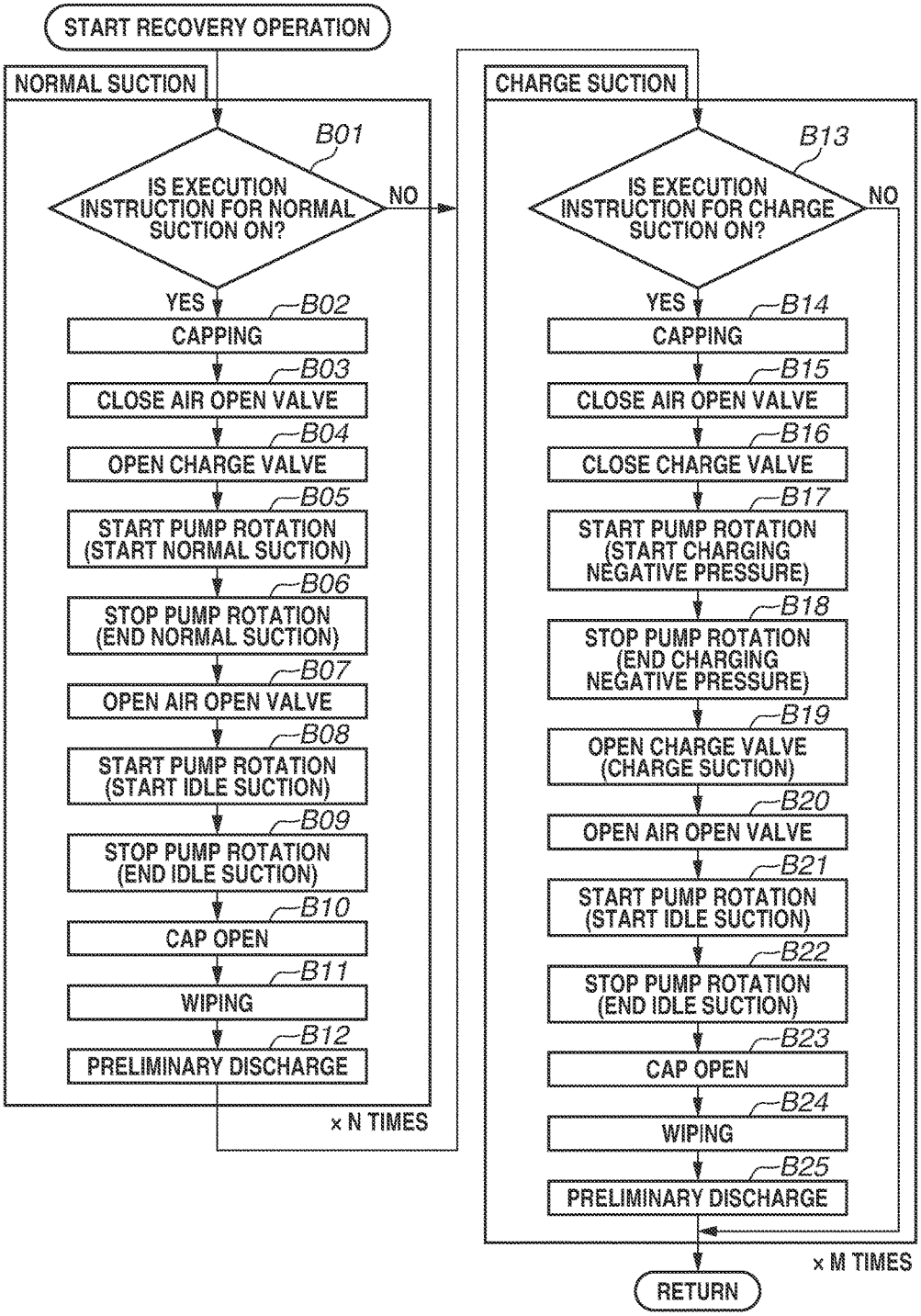
FIG. 11 is a flowchart illustrating a recovery operation according to the first exemplary embodiment.

FIG. 11 is a flowchart illustrating a recovery operation according to the present exemplary embodiment. In the recovery operation according to the present exemplary embodiment, the charge suction is successively performed after the normal suction. The normal suction refers to a suction operation not using the charge valve 602 illustrated in FIG. 6. The charge suction refers to a suction operation using the charge valve 602.

If the recovery operation is started, in step B01, the CPU 700 determines whether an execution instruction for the normal suction is ON. If the execution instruction for the normal suction is OFF (NO in step B01), the processing proceeds to step B13 which relates to the charge suction. If the execution instruction for the normal suction is ON (YES in step B01), the processing proceeds to step B02. In step B02, the CPU 700 performs capping to cover the discharge port surface 1021 of the recording head 102 with the cap 26. In step B03, the CPU 700 closes the air open valve 601 to cut off the air open channel between air open valve 601 and the cap 26. The normal suction does not use the charge valve 602. In step B04, the CPU 700 thus opens the charge valve 602. In step B05, the CPU 700 rotates the pump 25 to start the normal suction. In step B06, after the pump 25 is rotated for a predetermined number of rotations, the CPU 700 stops rotating the pump 25 to end the normal suction.

In step B07, the CPU 700 opens the air open valve 601 to make the interior of the cap 26 communicate with the air. In step B08, the CPU 700 rotates the pump 25 again to suck in and discharge ink remaining in the cap 26 (hereinafter, referred to as idle suction). In step B09, after the pump 25 is rotated for a predetermined number of rotations, the CPU 700 stops rotating the pump 25 to end the idle suction. In step B10, the CPU 700 separates the cap 26 with which the discharge port surface 1021 has been capped from the recording head 102 to bring the cap 26 into a cap open state. In step B11, the discharge port surface 1021 is wiped by a not-illustrated wiper. In step B12, the CPU 700 performs a preliminary discharge to end the normal suction. The interior of the cap 26 may be made to communicate with the air by opening the air open valve 601 in a state where the recording head 102 is still capped with the cap 26.

The foregoing normal suction is intended to discharge bubbles from the nozzles and fill the nozzles and the common ink chambers 105 with the ink.

After the normal suction, the charge suction is performed. In step B13, the CPU 700 initially determines whether an execution instruction for the charge suction is ON. If the execution instruction for the charge suction is OFF (NO in step B13), the processing is ended. If the execution instruction for the charge suction is ON (YES in step B13), the processing proceeds to step B14 and the subsequent steps. In steps B14 and B15, the CPU 700 performs capping and closes the air open valve 601 as in steps B02 and B03 of the normal suction. The charge suction uses the charge valve 602. In step B16, the CPU 700 then closes the charge valve 602. In step B17, the CPU 700 rotates the pump 25. This forms a decompressed space in the tube 606 arranged between the pump 25 and the charge valve 602, whereby a negative pressure is charged. The pressure charged here is controlled by the number of rotations and the rotation speed of the rollers 605 which are defined in advance. In step B18, the CPU 700 stops rotating the pump 25 to end charging the negative pressure. In step B19, the CPU 700 opens the charge valve 602 to suck in the ink from the recording head 102 (the charge suction).

In step B20, the CPU 700 opens the air open valve 601 to make the interior of the cap 26 communicate with the air pressure. In step B21, the CPU 700 starts rotating the pump 25 to perform idle suction of ink remaining in the cap 26. In step B22, the CPU 700 stops rotating the pump 25 to end the idle suction. Steps B23 to B25 are similar to steps B10 to B12 of the normal suction. When a preliminary discharge is completed in step B25, the charge suction ends and the entire recovery operation ends.

The foregoing charge suction is performed by charging a negative pressure by using the charge valve 602. The negative pressure acting on the recording head 102 is thus higher than in the normal suction. Bubbles can thus be sufficiently discharged from and the ink can be sufficiently filled into even the 1-pl nozzles which have a smaller nozzle diameter and a higher meniscus of the liquid surface. In the present exemplary embodiment, the normal suction and the charge suction are both described to be performed once. However, the present invention is not limited thereto. The normal suction may be performed N times ($N \geq 1$). The charge suction may be performed M times ($M \geq 1$).

Figure 12:
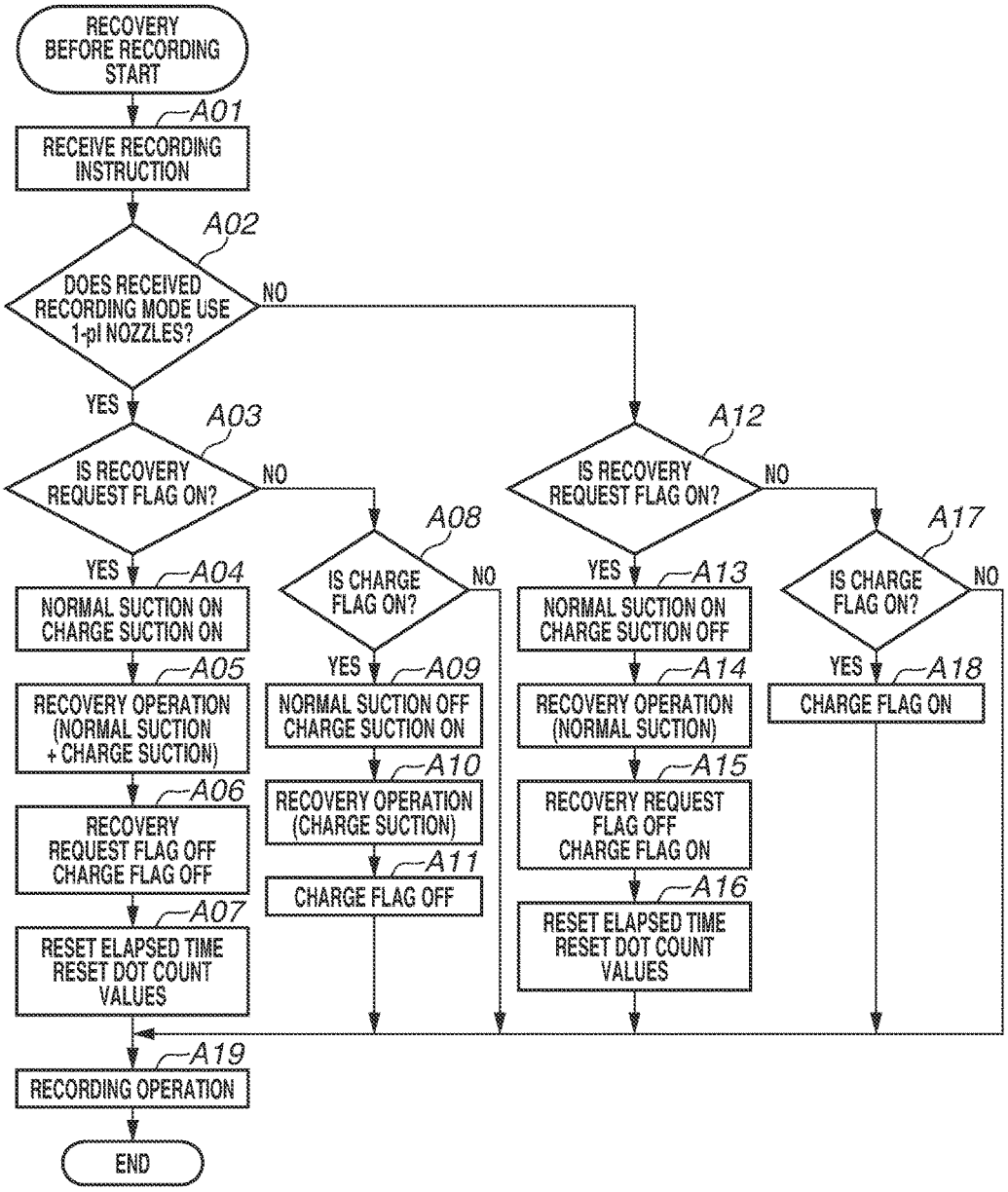
FIG. 12 is a flowchart illustrating control of recovery operations according to the first exemplary embodiment.

Such recovery operations are performed before a recording operation. In the present exemplary embodiment, the CPU 700 controls whether to perform the normal suction and whether to perform the charge suction, depending on whether a recording mode received from the host apparatus uses the 1-pl nozzles. In other words, the CPU 700 selects any one of the four cases: perform both the normal suction and the charge suction, perform only the normal suction, perform only the charge suction, and perform no recovery operation. The control of such recovery operations will be described with reference to FIG. 12. Specifically, if a recovery operation is needed before a recording operation is performed in a recording mode not using the 1-pl nozzles, only the normal suction is performed without the charge suction. If a recovery operation is needed before a recording operation is performed in a recording mode using the 1-pl nozzles, both the normal suction and the charge suction are performed or only the charge suction is performed.

Two flags are used for such a control of recovery operations. One is the foregoing recovery request flag. The recovery request flag is set to ON if a recovery operation including the normal suction is needed based on the conditions illustrated in FIGS. 8, 9, and 10. The recovery request flag is set to OFF if the normal suction is performed. The other flag is a charge flag (second flag). The charge flag is set to ON if the charge suction is needed. The charge flag is set to OFF if the charge suction is performed. While the charge flag can be independently set to ON and OFF, the charge flag is configured to be simultaneously set to ON when the recovery request flag is set to ON. The control using the two flags is described in detail below.

In step A01, the CPU 700 initially receives a recording instruction from the host apparatus. In step A02, the CPU 700 determines whether the recording mode received uses the 1-pl nozzles. Possible methods for determining the nozzles to be used may include one based on the type of the recording medium 14 (FIG. 13), one based on a layout method of ink droplets (dots) defined by a combination of the recording medium 14 and an image quality mode (FIGS. 14A and 14B), and one based on information about the nozzles to be heated.

In step A02, if the received recording mode is determined to use the 1-pl nozzles (YES in step A02), the processing proceeds to step A03. In step A03, the CPU 700 determines whether the recovery request flag is ON. As illustrated in FIGS. 8 to 10, the recovery request flag is set to ON if the ink tank 101 is replaced, if the elapsed time from the previous recovery operation reaches or exceeds a predetermined time, or if the number of dots used in recording operations after the previous recovery operation reaches or exceeds a predetermined value. The information about the recovery request flag is stored in the nonvolatile memory 704. If two or more recovery request flags are ON, the CPU 700 executes a recovery operation of the highest strength among those corresponding to the recovery request flags. The settings of suction time and suction pressure vary depending on the condition under which the recovery request flag is set to ON. Since the CPU 700 performs the recovery operation according to the recovery request flag that requests a recovery operation of the highest strength, all the recovery request flags may be turned OFF.

In step A03, if the recovery request flag is determined to be ON (YES in step A03), the processing proceeds to step A04. In step A04, the CPU 700 turns ON the execution instruction for the normal suction and the execution instruction for the charge suction. In step A05, the CPU 700 performs a recovery operation including both the normal suction and the charge suction according to the flowchart illustrated in FIG. 11. In the next step A06, the CPU 700 turns the recovery request flag and the charge flag OFF. In step A07, since the normal suction is performed in step A04, the CPU 700 resets the elapsed time from the previous recovery operation and resets the count values of the numbers of dots (dot count values) of the nozzles. In step A19, the CPU 700 starts a recording operation.

In step A03, if the recovery request flag is determined to not be ON (to be OFF) (NO in step A03), the processing proceeds to step A08. In step A08, the CPU 700 determines whether the charge flag is ON. In step A08, if the charge flag is determined to be ON (YES in step A08), the processing proceeds to step A09. In step A09, the CPU 700 turns the execution instruction for the normal suction OFF, and turns the execution instruction for the charge suction ON. In step A10, according to the execution instructions, the CPU 700 performs only the charge suction without the normal suction. In step A11, the CPU 700 turns the charge flag OFF. In step A19, the CPU 700 then starts a recording operation. On the other hand, in step A08, if the charge flag is determined to not be ON (to be OFF) (NO in step A08), the processing proceeds to step A19 without the CPU 700 performing the normal suction or the charge suction. In step A19, the CPU 700 starts a recording operation.

In step A02, if the received recording mode is determined to not use the 1-pl nozzles (NO in step A02), the processing proceeds to step A12. In step A12, the CPU 700 determines whether the recovery request flag is ON. In step A12, if the recovery request flag is determined to be ON (YES in step A12), the processing proceeds to step A13. In step A13, the CPU 700 turns the execution instruction for the normal suction ON, and turns the execution instruction for the charge suction OFF. In step A14, the CPU 700 performs only the normal suction without the charge suction. In step A15, the CPU 700 turns the recovery request flag OFF and the charge flag ON. In such a manner, the CPU 700 can manage the information about the unexecuted charge suction by using the flags. In step A16, since the normal suction is performed in step A14, the CPU 700 resets the elapsed time from the previous recovery operation and resets the dot count values of the nozzles. In step A19, the CPU 700 starts a recording operation.

In step A12, if the recovery request flag is determined to not be ON (to be OFF) (NO in step A12), the processing proceeds to step A17. In step A17, the CPU 700 determines whether the charge flag is ON. In step A17, if the charge flag is determined to be ON (YES in step A17), the processing proceeds to step A18. In step A18, the CPU 700 maintains the charge flag ON. In step A19, the CPU 700 starts a recording operation. In step A17, if the charge flag is determined to not be ON (to be OFF) (NO in step A17), the processing proceeds to step A19. In step A19, the CPU 700 starts a recording operation.

Next, methods for determining whether the received recording mode uses the 1-pl nozzles will be described with reference to FIGS. 13, 14A, and 14B. FIG. 13 illustrates a determination method based on the type of the recording medium 14 selected for recording. Types of nozzles to be used may be limited depending the type of the recording material 14. For example, if plain paper is used as the recording medium 14, the recording apparatus 1 uses only the 5-pl nozzles to record an image, not the 1-pl nozzles. On the other hand, if special paper such as glossy paper is used, the recording apparatus 1 uses both the 5-pl and 1-pl nozzles to record an image. The types of nozzles to be used thus vary depending on the type of the recording medium 14. The recording apparatus 1 makes such a determination by reading information about the type of the selected recording medium 14, which is attached to a header of recording data. The CPU 700 can thereby determine whether the received recording mode is one using the 1-pl nozzles.

FIG. 14 illustrates a determination method based on the layout of ink droplets (dots), defined by a combination of the recording medium 14 and the image quality mode. In the present exemplary embodiment, layouts of dots (dot arrangements) are defined according to combinations of recording media and image quality modes, and which dot arrangement uses which nozzles can thereby be determined. For example, FIG. 14A shows that a recording medium/image quality mode of plain paper/standard mode is associated with dot arrangement A. FIG. 14B shows that dot arrangement A uses only 5-pl ink droplets. If the user selects a recording medium and an image quality mode and inputs a recording instruction, the CPU 700 can thus obtain information about the nozzles to be used from the combination of the recording medium and the image quality mode. The recording apparatus 1 can read the information attached to the header of the recording data and determine whether the received recording mode uses the 1-pl nozzles.

As described above, the recording apparatus 1 normally performs a recovery operation in which two types of suction are performed in succession. The recording apparatus 1 can control recovery operations to omit either one type of suction, depending on whether the recording mode uses the 1-pl nozzles. Consequently, if a recording mode not using the 1-pl nozzles is received, a recovery operation time before a start of a recording operation is reduced for improved throughput. The time for which the user inputting a recording instruction for plain paper is kept waiting until a start of recording can also be reduced for improved usability. In addition, the control of the present exemplary embodiment to not perform unnecessary charge suction can reduce waste ink.

In the present exemplary embodiment, the recovery operation is described to perform the normal suction once and then the charge suction once. However, as illustrated in FIG. 11, a recovery operation may perform the normal suction N times ($N \geq 1$) and the charge suction M times ($M \geq 1$). The order of execution of the normal suction and the charge suction is not limited to that illustrated in FIG. 11, either. The charge suction may be performed M times before the normal suction is performed N times. The normal suction and the charge suction may be alternately performed once or a plurality of times each.

In the present exemplary embodiment, the recovery operation is described to be controlled by using the two types of flags, including one indicating whether the recovery operation itself is needed and one indicating whether the charge suction is needed. However, the recovery operation may be controlled by other methods. For example, two types of flags including one indicating whether the normal suction is needed and the foregoing one indicating whether the charge suction is needed may be used for control.

A second exemplary embodiment will be described below. In the first exemplary embodiment, the recording apparatus 1 is described to include the charge valve 602 and perform the normal suction and the charge suction in a recovery operation. In the present exemplary embodiment, a recording apparatus 1 that does not include a charge valve and performs two types of normal suction in a recovery operation will be described. A basic configuration is similar to that of the first exemplary embodiment. The present exemplary embodiment describes an example where the recording apparatus 1 which performs two or more types of normal suction in a recovery operation can omit one or more of the types of normal suction when in a recording mode not using the 1-pl nozzles.

Figure 15:
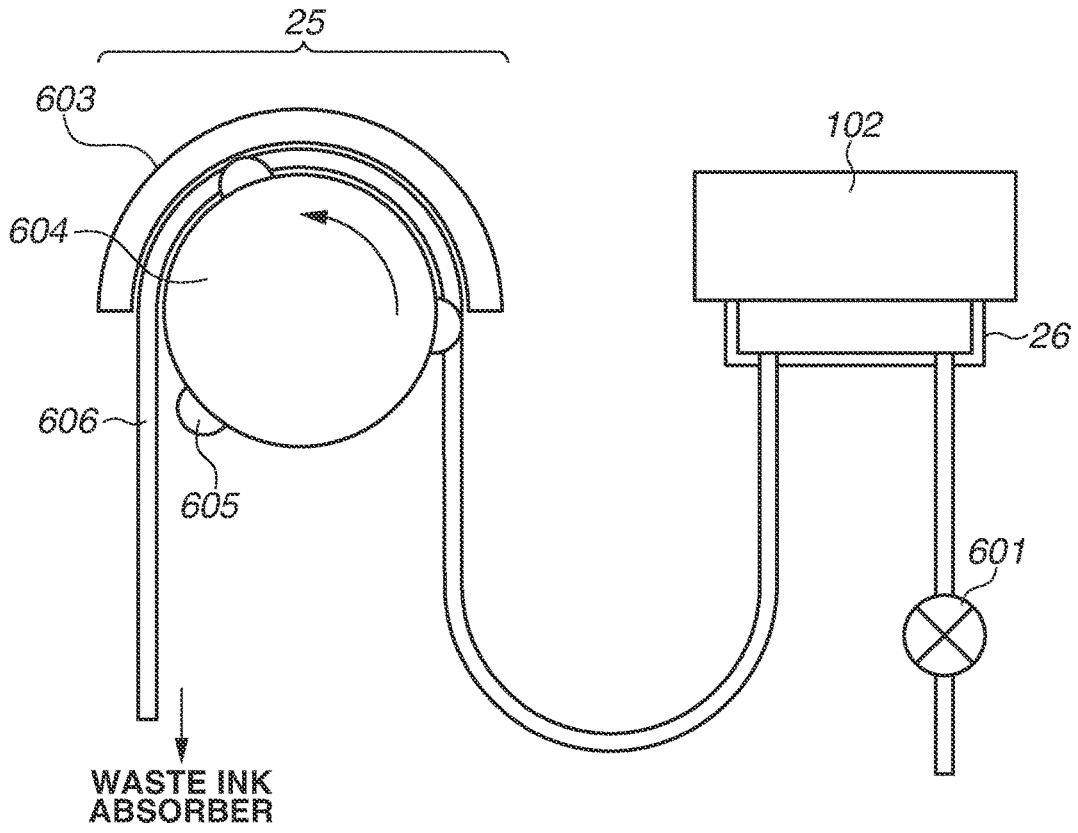
FIG. 15 is a schematic diagram illustrating a suction unit according to a second exemplary embodiment.
Figure 16:
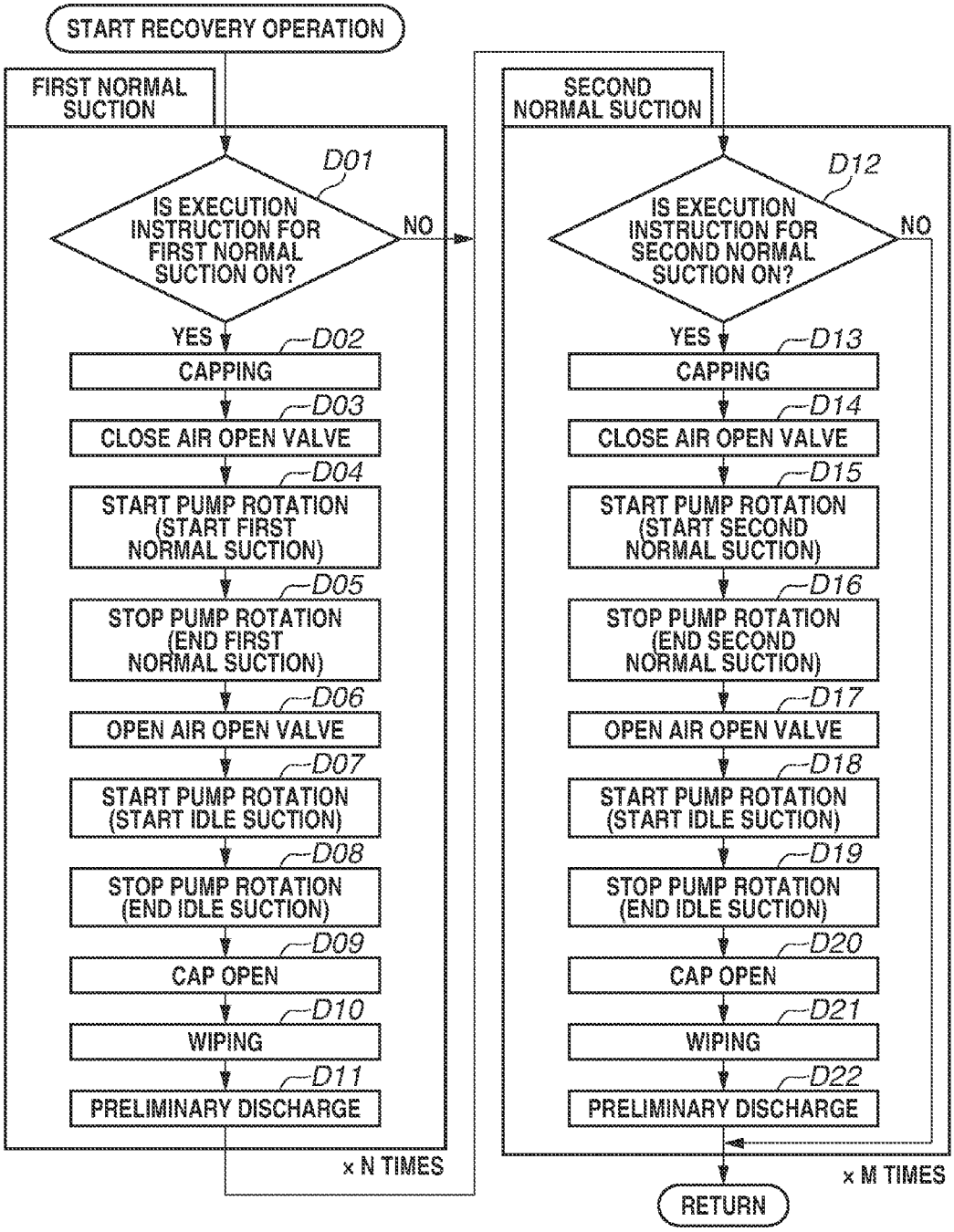
FIG. 16 is a flowchart illustrating a recovery operation according to the second exemplary embodiment.

FIG. 15 illustrates a suction unit that does not include the charge valve 602 of FIG. 6 according to the first exemplary embodiment. FIG. 16 is a flowchart illustrating steps for controlling recovery operations according to the present exemplary embodiment. First normal suction is a recovery operation performed to recover the 5-pl nozzles. The first normal suction is not omitted and performed even if the received recording mode does not use the 1-pl nozzles. Subsequent second normal suction is a recovery operation performed to recover the 1-pl nozzles. The second normal suction can be omitted if the received recording mode does not use the 1-pl nozzles.

In the present exemplary embodiment, such recovery operations are controlled by using two flags. One is the recovery request flag. The recovery request flag is set to ON if a recovery operation including the first normal suction is needed based on the conditions illustrated in FIGS. 8, 9, and 10. The recovery request flag is set to OFF if normal suction is performed. The other flag is a second recovery flag. The second recovery flag is set to ON if the second normal suction is needed. The second recovery flag is set to OFF if the second normal suction is performed. While the second recovery flag can be independently set to ON and OFF, the second recovery flag is configured to be simultaneously set to ON when the recovery request flag is set to ON. The count value of the elapsed time and the dot count values are reset at timing after a recovery operation including the first normal suction is performed. If a recovery operation including only the second normal suction is performed without the first normal suction, the count value of the elapsed time and the dot count values are not reset but continued. Control using the two flags will be described in detail below.

If the recovery operation is started, in step D01, the CPU 700 determines whether an execution instruction for the first normal suction is ON. If the execution instruction for the first normal suction is OFF (NO in step D01), the processing proceeds to the second normal suction to be described below (step D12). If the execution instruction for the first normal suction is ON (YES in step D01), the processing proceeds to step D02. In step D02, the cap 26 is pressed against the recording head 102 to cap the discharge port surface 1021. In step D03, the air open valve 601 is closed to cut off the communication between the air and the cap 26. In step D04, the CPU 700 starts rotating the pump 25 to start the first normal suction. In step D05, after the pump 25 is rotated by a predetermined number of rotations, the CPU 700 stops rotating the pump 25 to end the first normal suction. In step D06, the CPU 700 opens the air open valve 601 to make the interior of the cap 26 communicate with the air. In step D07, the CPU 700 rotates the pump 25 again to perform idle suction of ink remaining in the cap 26. In step D08, after the pump 25 is rotated a predetermined number of rotations, the CPU 700 stops rotating the pump 25 to stop the idle suction. In step D09, the cap 26 with which the recording head 102 has been capped is separated from the recording head 102. In step D10, the discharge port surface 1021 is wiped. In step D11, a preliminary charge is performed to end the first normal suction.

The second normal suction is successively performed after the end of the first normal suction. In step D12, the CPU 700 determines whether an execution instruction for the second normal suction is ON. If the execution instruction for the second normal suction is OFF (NO in step D12), the processing is ended. If the execution instruction for the second normal suction is ON (YES in step D12), the processing proceeds to step D13 and the subsequent steps. Steps D13 to D22 of the second normal suction are similar to steps D02 to D11 of the foregoing first normal suction. In step D15, the second normal suction is performed with a suction strength higher than that of the first normal suction so that the 1-pl nozzles can be sufficiently recovered. Specifically, the suction time or suction pressure of the second normal suction is set to be longer or higher than that of the first normal suction. As illustrated in FIG. 16, the first normal suction and the second normal suction may be performed N times and M times (N≥1, M≥1), respectively.

Figure 17:
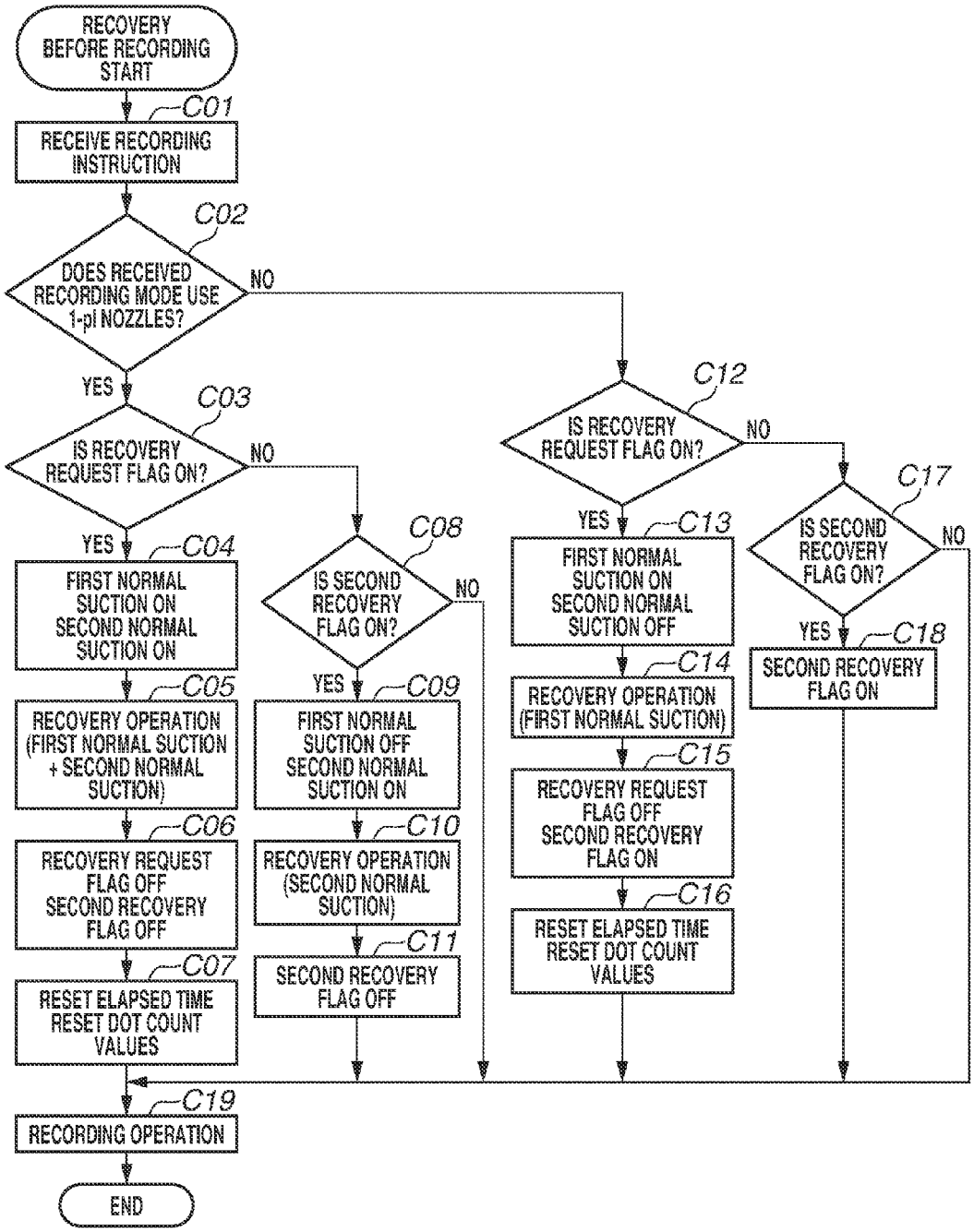
FIG. 17 is a flowchart illustrating control of recovery operations according to the second exemplary embodiment.

Next, a flow of recovery before recording according to the present exemplary embodiment when the first normal suction is performed twice (N=2) and the second normal suction is performed once (M=1) in a recovery operation will be described with reference to FIG. 17. In step C01, the CPU 700 receives a recording instruction. In step C02, the CPU 700 determines whether the recording mode received uses the 1-pl nozzles. If the received recording mode is determined to use the 1-pl nozzles (YES in step C02), the processing proceeds to step C03. In step C03, the CPU 700 determines whether the recovery request flag is ON.

In step C03, if the recovery request flag is determined to be ON (YES in step C03), the processing proceeds to step C04. In step C04, the CPU 700 turns ON the execution instructions for the first normal suction and the second normal suction. In step C05, the CPU 700 performs a recovery operation including both the first normal suction and the second normal suction. In step C06, the CPU 700 turns OFF the recovery request flag and the second recovery flag. The reason is that the second recovery flag is simultaneously set to ON when the recovery request flag is set to ON. In step C07, since the first normal suction is performed in step C05, the CPU 700 resets the elapsed time and the dot count values from the previous recovery operation. In step C19, the CPU 700 starts a recording operation.

In step C03, if the recovery request flag is determined to not be ON (to be OFF) (NO in step C03), the processing proceeds to step C08. In step C08, the CPU 700 determines whether the second recovery flag is ON. In step C08, if the second recovery flag is determined to not be ON (to be OFF)

(NO in step C08), the processing proceeds to step C19. In step C19, the CPU 700 starts a recording operation. In step C08, if the second recovery flag is determined to be ON (YES in step C08), the processing proceeds to step C09. In step C09, the CPU 700 turns the execution instruction for the first normal suction OFF, and turns the execution instruction for the second normal suction ON. In step C10, the CPU 700 performs a recovery operation in which only the second normal suction is performed without the first normal suction. In step C11, the CPU 700 turns the second recovery flag OFF. The processing then proceeds to step C19. In step C19, the CPU 700 starts a recording operation.

In step C02, if the received recording mode is determined to not use the 1-pl nozzles (NO in step C02), the processing proceeds to step C12. In step C12, the CPU 700 determines whether the recovery request flag is ON. In step C12, if the recovery request flag is determined to be ON (YES in step C12), the processing proceeds to step C13. In step C13, the CPU 700 turns the execution instruction for the first normal suction ON and the execution instruction for the second normal suction OFF. In step C14, the CPU 700 performs a recovery operation in which only the first normal suction is performed without the second normal suction. In step C15, the CPU 700 turns the recovery request flag OFF and the second recovery flag ON. In step C16, the CPU 700 resets the elapsed time and the dot count values from the previous recovery operation. In step C19, the CPU 700 starts a recording operation.

In step C12, if the recovery request flag is determined to not be ON (to be OFF) (NO in step C12), the processing proceeds to step C17. In step C17, the CPU 700 determines whether the second recovery flag is ON. If the second recovery flag is determined to be ON (YES in step C17), the processing proceeds to step C18. In step C18, the CPU 700 maintains the second recovery flag ON. In step C19, the CPU 700 starts a recording operation. In step C17, if the second recovery flag is determined to not be ON (to be OFF) (NO in step C17), the processing proceeds to step C19 without the CPU 700 performing any recovery operation. In step C19, the CPU 700 starts a recording operation.

As described above, even if a recovery operation is performed to perform two or more types of normal suction, similar effects to those of the first exemplary embodiment can be obtained. In the present exemplary embodiment, the recovery operation is described to perform the first normal suction twice and then the second normal suction once. However, the numbers of times and order of execution of the steps are not limited thereto. The first normal suction and the second normal suction may be alternately performed once or a plurality of times each. According to an exemplary embodiment of the present invention, an inkjet recording apparatus that performs an appropriate suction operation according to the type(s) of discharge ports used in a recording operation is provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150411, filed Jul. 29, 2016, which is hereby incorporated by reference herein in its entirety.

What is claimed is:

1. An inkjet recording apparatus comprising:

a recording head configured to perform a recording operation on a recording medium, the recording head including a discharge port surface in which a first discharge port configured to discharge a first amount of ink droplets and a second discharge port configured to discharge a second amount of ink droplets are formed, the second amount being smaller than the first amount;

a cap configured to cover the discharge port surface;

a pump connected to the cap and configured to suck ink from the recording head when the cap covers the discharge port surface;

a valve arranged between the cap and the pump, the valve being capable of switching between an open state in which the cap communicates with the pump and a closed state in which the cap does not communicate with the pump;

a determination unit configured to determine which of a plurality of recording operations to be performed by the recording head, the plurality of recording operations including a first recording operation for performing recording on the recording medium by using the first and second discharge ports and a second recording operation for performing recording on the recording medium by using the first discharge port without using the second discharge port; and a control unit configured to if the determination unit determines to perform the first recording operation, control to perform a first suction operation and a second suction operation before the first recording operation wherein the first suction operation is an operation of sucking the ink by driving the pump with the valve opened, and wherein the second suction operation is an operation of sucking the ink by opening the valve after driving the pump for a predetermined time with the valve closed, and, wherein the control unit is configured to, if the determination unit determines to perform the second recording operation, control not to perform the second suction operation and to perform the first suction operation before the second recording operation.

2. The inkjet recording apparatus according to claim 1, wherein suction pressure of the second suction operation is higher than that of the first suction operation.

3. The inkjet recording apparatus according to claim 1, wherein the control unit is configured to control the first and second suction operations by using a first flag and a second flag, and if the first flag is set to ON, control to perform the first suction operation.

4. The inkjet recording apparatus according to claim 3, wherein if the first flag is set to ON, the second flag is set to ON.

5. The inkjet recording apparatus according to claim 3, wherein the first flag is set to ON when elapsed time from the previous first suction operation exceeds a predetermined time.

6. The inkjet recording apparatus according to claim 3, wherein the first flag is set to ON when a discharge amount of ink discharged from the first or second discharge port since the previous first suction operation exceeds a predetermined value.

7. The inkjet recording apparatus according to claim 3, further comprising:

an ink tank connected to the recording head and configured to supply the ink to the recording head; and a carriage on which the recording head and the ink tank are mounted, wherein the first flag is set to ON when time during which the ink tank is not mounted on the carriage exceeds a predetermined time.

8. The inkjet recording apparatus according to claim 3, wherein the control unit is configured to, if the first flag is set to ON before the recording head performs the first recording operation, control to perform the first and second suction operations.

9. The inkjet recording apparatus according to claim 3, wherein the control unit is configured to, if the first flag is set to OFF and the second flag is set to ON before the recording head performs the first recording operation, control not to perform the first suction operation and to perform the second suction operation.

10. The inkjet recording apparatus according to claim 3, wherein the control unit is configured to, if the first flag is set to ON before the recording head performs the second recording operation, control not to perform the second suction operation and to perform the first suction operation.

11. The inkjet recording apparatus according to claim 10, wherein the control unit is configured to set the first flag to OFF and the second flag to ON after performing the first suction operation.

12. The inkjet recording apparatus according to claim 3, wherein the control unit is configured to, if the first and second flags are set to OFF before the recording head performs the first or second recording operation, control not to perform the first suction operation or the second suction operation.

13. The inkjet recording apparatus according to claim 3, wherein the control unit is configured to set the first flag to OFF after performing the first suction operation, and set the second flag to OFF after performing the second suction operation.

14. The inkjet recording apparatus according to claim 1, wherein the first recording operation is performed if the recording medium is glossy paper, and the second recording operation is performed if the recording medium is plain paper.

15. A cleaning method of an inkjet recording apparatus, the inkjet recording apparatus including a recording head configured to perform a recording operation on a recording medium, the recording head including a discharge port surface in which a first discharge port configured to discharge a first amount of ink droplets and a second discharge port configured to discharge a second amount of ink droplets are formed, the second amount being smaller than the first amount, a cap configured to cover the discharge port surface, a pump connected to the cap and configured to suck ink from the recording head when the cap covers the discharge port surface, and a valve arranged between the cap and the pump, the valve being capable of switching between an open state in which the cap communicates with the pump and a closed state in which the cap does not communicate with the pump, the cleaning method comprising:

determining which of a plurality of recording operations to be performed by the recording head, the plurality of recording operations including a first recording operation for performing recording on the recording medium by using the first and second discharge ports and a second recording operation for performing recording on the recording medium by using the first discharge port without using the second discharge port;

controlling if the first recording operation is determined to be performed to perform a first suction operation and a second suction operation before the first recording operation wherein the first suction operation is an operation of sucking the ink by driving the pump with the valve opened, and wherein the second suction operation is an operation of sucking the ink by opening the valve after driving the pump for a predetermined time with the valve closed, and; and controlling, if the second recording operation is determined to be performed, not to perform the second suction operation and to perform the first suction operation before the second recording operation.

* * * * *